US007678977B2

(12) United States Patent
Yoshisue et al.

(10) Patent No.: US 7,678,977 B2
(45) Date of Patent: Mar. 16, 2010

(54) REPETITION LEVER OF GRAND PIANO

(75) Inventors: Kenji Yoshisue, Shizuoka-ken (JP); Hirotaka Higasa, Shizuoka-ken (JP); Tsutomu Kihara, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/575,686

(22) PCT Filed: Oct. 13, 2004

(86) PCT No.: PCT/JP2004/015064

§ 371 (c)(1),
(2), (4) Date: Jul. 24, 2006

(87) PCT Pub. No.: WO2005/036521

PCT Pub. Date: Apr. 21, 2005

(65) Prior Publication Data

US 2007/0012156 A1 Jan. 18, 2007

(30) Foreign Application Priority Data

Oct. 14, 2003 (JP) ..... 2003-354274
Jan. 13, 2004 (JP) ..... 2004-006013

(51) Int. Cl.
*G10C 3/00* (2006.01)

(52) U.S. Cl. ..... 84/234; 84/236; 428/297.4

(58) Field of Classification Search ..... 84/234, 84/235–255; 428/297.4
See application file for complete search history.

(56) References Cited

U.S. PATENT DOCUMENTS 5,911,167 A * 6/1999 Jones et al. ..... 84/236
6,051,307 A * 4/2000 Kido et al. ..... 428/297.4

FOREIGN PATENT DOCUMENTS

| | | |
|---|---|---|
| JP | 2-67326 | 3/1990 |
| JP | 9-281959 | 10/1997 |
| JP | 2000-263547 | 9/2000 |
| JP | 2000-290447 | 10/2000 |
| JP | 2001-306062 | 11/2001 |
| JP | 2003-5740 | 1/2003 |
| JP | 2003-66951 | 3/2003 |
| JP | 2003-238818 | 8/2003 |
| JP | 2004226949 A * | 8/2004 |
| WO | WO 01/59009 A1 | 8/2001 |

* cited by examiner

*Primary Examiner*—Jeffrey Donels
*Assistant Examiner*—Jianchun Qin
(74) *Attorney, Agent, or Firm*—Crowell & Moring LLP

(57) ABSTRACT

There is provided a repetition lever for a grand piano, which is excellent in shape retainability and dimensional stability and is light in weight and high in rigidity, thereby enabling required operations to be stably performed and improving the capability of repeated key striking. A repetition lever 4 for a grand piano, which performs the operation of pushing up a hammer 30 after the hammer has struck a string, is formed by a molded article of a thermoplastic resin containing long fibers for reinforcement, the molded article being molded by a long fiber process. The repetition lever 4 has reduced cross-sectional area portions 49, 50, and 54 for reducing weight thereof. The long fibers for reinforcement are carbon fibers, and the thermoplastic resin is an ABS resin.

11 Claims, 3 Drawing Sheets

(a)

(b)

(c)

REPETITION LEVER OF GRAND PIANO

FIELD OF THE INVENTION

The present invention relates to a repetition lever for a grand piano, which performs the operation of pushing up a hammer after the hammer has struck a string, so as to ensure the capability of repeated key striking in an acoustic grand piano or the like.

BACKGROUND ART

An action for a grand piano, including a repetition lever, is generally configured as follows: The action of a grand piano is provided in a manner pivotally movable about a rear end thereof, and includes a wippen disposed on a rear part of a key, and a repetition lever and a jack which are pivotally mounted to the wippen. The repetition lever is mounted to the wippen in a state engaged with a bifurcated lever-mounting part of the wippen. The repetition lever extends in the front-rear direction, and a hammer is disposed on an upper surface of the repetition lever via a shank roller. The upper end of the jack is engaged in a jack guide hole formed in the repetition lever, and is opposed to the shank roller from below with a slight space therebetween in a key-released state. Further, the repetition lever and the jack are urged in a returning direction by a repetition spring, and in the key-released state, the jack is opposed to a regulating button from below with a slight space therebetween.

With the arrangement described above, when the key is depressed, the wippen is pushed up, whereby the repetition lever and the jack are pivotally moved upward along with the wippen. With this pivotal motion, the jack pushes up the hammer via the shank roller. Thereafter, when the hammer pivotally moves immediately close to a position for striking a string stretched above, the jack comes into engagement with the regulating button to be released from the shank roller. This disconnects the hammer from the action and the key and causes the hammer to strike the string in a free rotation state. After having struck the string, the hammer pivotally moves in the opposite direction.

Then, when the key is released, the repetition lever is pivotally returned by the resilient force of the repetition spring to thereby push up the hammer via the shank roller in timing in which the key is returned to a predetermined height. As a consequence, the jack is pivotally returned by the resilient force of the repetition spring to be positioned under the shank roller, whereby a following string-striking operation can be reliably performed even when the key is not completely returned. This ensure the capability of repeated key striking.

As is apparent from the above, the repetition lever is a component part for pushing up the hammer via the shank roller after the hammer has struck the string, so as to attain repeated key striking, such as a trill in which the same key is repeatedly struck. Conventionally, in general, the repetition lever is made of wood, similarly to many other action component parts. This is because wood is advantageous in that it is easily available and excellent in machinability as well as highly rigid in spite of its light weight. In particular, the repetition lever is required to be not only light in weight for making pivotal motion lightly with quick response to key release so as to push up the hammer in predetermined timing responsive to the key release, but also highly rigid so as to prevent the repetition lever from being largely warped during the operation of pushing up the hammer.

Further, a conventional repetition lever made of a synthetic resin has been disclosed e.g. in Patent Literature 1. This repetition lever is made of an ABS resin etc., and has a conductive coating or metal layer formed at least on a surface thereof so as to prevent the repetition lever from being electrostatically charged.

As described above, wood is generally used as a material for the conventional repetition lever because wood is not only light but also high in rigidity. However, since wood, which is a natural material, lacks homogeneity, it suffers from variations in rigidity and weight, and is prone to deformation, such as warpage or distortion, due to residual stress. Further, wood undergoes large dimensional change due to dryness and wetness, and hence relatively large transverse expansion or contraction of the repetition lever occurs depending on humidity. As a result, the clearance between the lever-mounting part of the wippen and the repetition lever changes, which loosens or tightens engagement between the repetition lever and the wippen. The deformation of the repetition lever and the change in clearance between the lever-mounting part of the wippen and the repetition lever can make the operation of the repetition lever unstable.

On the other hand, in the case where the repetition lever is made of the ABS resin as disclosed in Patent Literature 1, since the ABS resin is excellent in shape retainability and dimensional stability, the above described problems with the wooden repetition lever cannot occur. Further, the repetition lever made of the ABS resin is advantageous in that it can be machined with high accuracy and material costs can be reduced. However, since the ABS resin has a larger specific gravity than wood, the lightness of the repetition lever is impaired, which makes its motion slow. Further, since the ABS resin has a lower rigidity than wood, the repetition lever made of the ABS resin is largely warped in pushing up the hammer, which causes a lag in timing in which the hammer is pushed up. Thus, the advantages of the wooden repetition lever are lost, and hence the capability of repeated key striking is degraded.

The present invention has been made in order to solve the above problems, and an object thereof is to provide a repetition lever for a grand piano, which is excellent in shape retainability and dimensional stability and is light in weight and high in rigidity, thereby enabling required operations to be stably performed and improving the capability of repeated key striking.

[Patent Literature 1] Japanese Laid-Open Patent Publication (Kokai) No. 2003-5740

DISCLOSURE OF THE INVENTION

To attain the above object, the invention as claimed in claim 1 is a repetition lever for a grand piano, which performs the operation of pushing up a hammer after the hammer has struck a string, wherein the repetition lever is formed by a molded article of a thermoplastic resin containing long fibers for reinforcement, the molded article being molded by a long fiber process.

The above-mentioned long fiber process is for obtaining a molded article by injection molding of a pellet that contains fibrous reinforcements having the same length and coated with a thermoplastic resin. According to this long fiber process, differently from the case where a molded article is molded by injection molding of a pellet simply containing short fibers as reinforcements, relatively long fibrous reinforcements are caused to be contained in the molded article.

Therefore, the repetition lever according to the present invention contains relatively long reinforcing long fibers, and hence can have a very high rigidity compared with a repetition lever made only of a synthetic resin, such as an ABS resin. This makes it possible to obtain a rigidity not lower than that of a wooden repetition lever. As a consequence, it is possible to suppress deflection of the repetition lever occurring in pushing up the hammer having struck the string, and thereby enabling the repetition lever to perform the operation of pushing up the hammer in predetermined timing. Further, since the molded article molded by the long fiber process is as excellent in shape retainability and dimensional stability as the molded article of a single synthetic resin, it is possible to reduce deformation, such as warpage and torsion, of the repetition lever and expansion and contraction of the same due to dryness and wetness to much smaller amounts than in the case where the repetition lever is made of wood. This makes it possible to ensure the stable operation of the repetition lever and enhance the capability of repeated key striking.

The invention as claimed in claim 2 is a repetition lever as claimed in claim 1 wherein the long fibers have a length not shorter than 0.5 mm.

With this configuration, since the reinforcing long fibers having a length not shorter than 0.5 mm are contained in the molded article, it is possible to obtain a very high rigidity, and hence ensure a rigidity required for the repetition lever.

The invention as claimed in claim 3 is a repetition lever as claimed in claim 1 or 2 wherein the long fibers are carbon fibers.

In general, carbon fibers have a higher electric conductivity than other reinforcing long fibers, such as glass fibers. Therefore, by using carbon fibers as the reinforcing long fibers, the electric conductivity of the repetition lever is increased, whereby it is possible to reliably release static electricity generated by friction between the repetition lever and other component parts including the hammer, and thereby prevent the repetition lever from being electrostatically charged. This makes it possible to suppress attachment of dust to the repetition lever and its neighborhood, thereby maintaining excellent operation and appearance of the repetition lever.

The invention as claimed in claim 4 is a repetition lever as claimed in any one of claims 1 to 3 wherein the thermoplastic resin is an ABS resin.

In general, other component parts, such as a lever skin for contact with a drop screw, are attached to the repetition lever. The ABS resin has a relatively high adhesiveness among the thermoplastic resins, and therefore by using the ABS resin as the thermoplastic resin for forming the repetition lever, the lever skin and other component parts can be easily mounted to the repetition lever by bonding, which increases the ease of assembly of the repetition lever.

The invention as claimed in claim 5 is a repetition lever as claimed in any one of claims 1 to 4 wherein the repetition lever has a reduced cross-sectional area portion for reducing weight thereof.

With this configuration, since the reduced cross-sectional area portion contributes to reduction of the weight of the repetition lever, it is possible to enhance the lightness of the repetition lever. Further, according to the present invention, since the repetition lever has its rigidity increased by the reinforcing long fibers as described above, a rigidity required for the repetition lever can be maintained in spite of the reduction of the cross section of the repetition lever by the reduced cross-sectional area portion. Thus, it is possible to reduce the weight of the repetition lever as much as possible while maintaining the required rigidity, thereby improving the capability of repeated key striking. Further, since the repetition lever is molded by injection molding, it is possible to form the reduced cross-sectional area portion with ease and high accuracy during molding of the repetition lever.

Views of a repetition lever for a grand piano, according to an embodiment of the present invention, in which (a) is a plan view, (b) is a side view, and (c) is a bottom view.

[FIG. 2]

Figure 1:
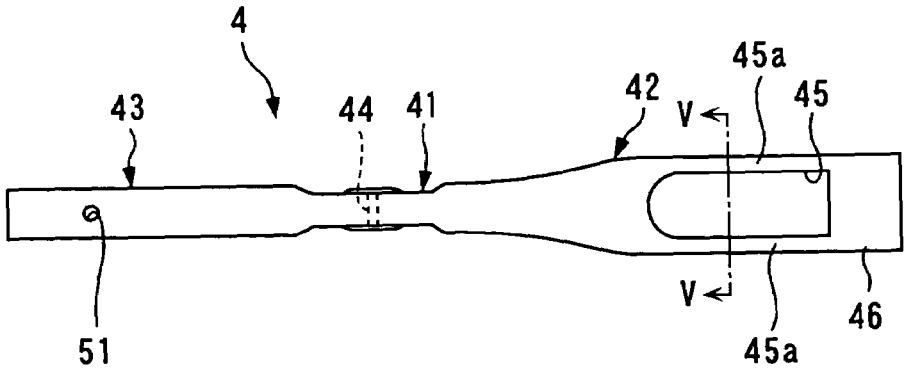
[FIG. 1]
Figure 1:
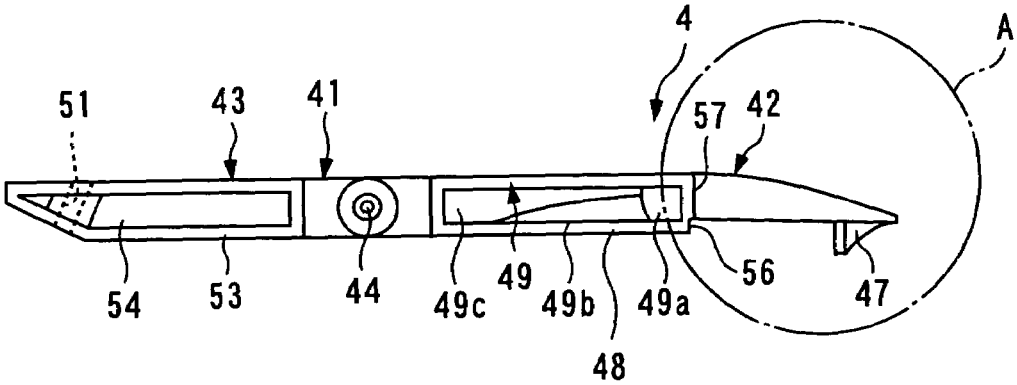
Figure 1:
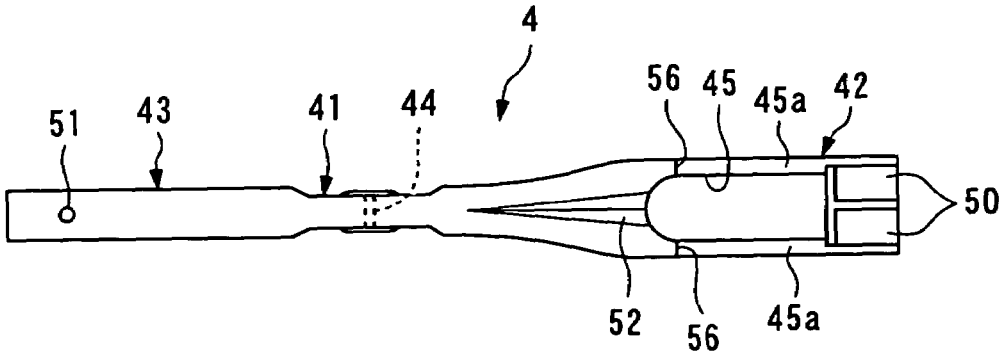

A side view of a keyboard apparatus for a grand piano, including the repetition lever shown in FIG. 1.

[FIG. 3]

A diagram showing a result of a rigidity test carried out on the repetition lever, together with Comparative Example.

[FIG. 4]

A fragmentary enlarged side view of a portion A in (b) of FIG. 1.

[FIG. 5]

A cross-sectional view taken on line V-V of (a) of FIG. 1.

BEST MODE FOR CARRYING OUT THE INVENTION

The invention will now be described in detail with reference to the drawings showing a preferred embodiment thereof. In the following description, a player's side of a grand piano (right side as viewed in FIG. 2) will be referred to as "front", and a remote side from the player's side as "rear". Further, a direction in which keys 2 are arranged is referred to as "the transverse direction".

First, a repetition lever 4 will be described with reference to FIG. 1. In the present embodiment, the repetition lever 4 is formed by a thermoplastic resin molded component which is molded by a long fiber process. For example, the repetition lever 4 is obtained by injection molding using a pellet as described below. The pellet is formed by coating roving formed of carbon fibers oriented by application of a predetermined tensile force thereto, e.g. with an ABS resin, which is a thermoplastic resin containing a rubbery polymer, extruded from an extruder. This makes it possible to cause the carbon fibers to be contained in the formed pellet without breaking the roving of carbon fibers when the pellet is formed, and hence carbon fibers having the same length as that of the pellet can be contained in the pellet. In the present embodiment, the length of the pellet is set to 5 to 15 mm, so that carbon fibers having a length of 0.5 to 2 mm are contained in the repetition lever 4 formed by injection molding using the pellet.

As shown in FIG. 1, the repetition lever 4 is a rod-like member extending in the front-rear direction, and is formed integrally with a wippen-mounting part 41 formed in a central part thereof, a shank roller-pushing part 42 extending forward from the wippen-mounting part 41, and a lever button-mounting part 43 extending rearward from the wippen-mounting part 41.

The wippen-mounting part 41 has a rectangular cross section having substantially fixed width and height, and a mounting hole 44 for mounting the repetition lever 4 to a wippen 3 (see FIG. 2) is formed to extend through a central part of the wippen-mounting part 41 in the transverse direction.

The shank roller-pushing part 42 is larger in width than the wippen-mounting part 41. The width of the shank roller-pushing part 42 is gently increased toward the front, and the width of the front half of the shank roller-pushing part 42 is fixed. Further, the height of the rear half of the shank roller-pushing part 42 is equal to that of the wippen-mounting part 41, and the upper surface of the front half of the same slopes in a downwardly curved manner. The front half of the shank roller-pushing part 42 is formed with a jack guide hole 45 vertically extending therethrough and elongated in the front-rear direction, and the front end part of the upper surface of the front half is formed as a skin-mounting part 46 for mounting a lever skin 39 (see FIG. 2) thereon.

Figure 4:
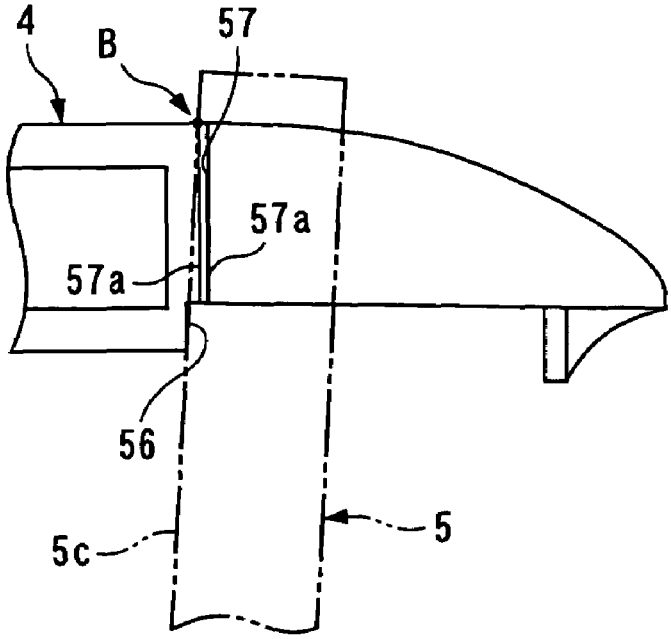

As shown in FIG. 4, the lower surface of the front half of the shank roller-pushing part 42 is one step higher than that of the rear half of the same, whereby lower stepped parts 56 are formed between the front half and the rear half. Further, grooves 57 are formed at respective locations close to the front side of the lower stepped parts 56. The grooves 57 extend vertically along the whole height in the respective left and right outer side surfaces of the shank roller-pushing part 42. Front and rear edges of each groove 57 form marking lines 57*a* and 57*a*. The grooves 57 and the marking lines 57*a* are at approximately right angles to the lower surface of the shank roller-pushing part 42, and the front surface of each lower stepped part 56 slopes at a predetermined small angle relative to the associated marking line 57*a*. The lower stepped parts 56 and the marking lines 57*a* are used as a reference in adjusting the angular position of the jack 5 of the action 1 with respect to the repetition lever 4.

Further, the upper surface of the shank roller-pushing part 42 is chamfered. More specifically, each of left and right wall parts 45*a* and 45*a* defining the jack guide hole 45 has its left and right upper edges chamfered during molding to form rounded parts 45*b* having a radius of 0.2 to 0.5 mm.

The rear half of the shank roller-pushing part 42 has first recessed parts 49 (only one of which is shown) formed in respective left and right side surfaces thereof to form a reduced cross-sectional area portion, with peripheries 48 thereof left unrecessed. More specifically, the first recessed part 49 is comprised of a portion 49*a* having its depth progressively increased rearward from a location close to the jack guide hole 45, a portion 49*b* having its depth progressively increased upward part way from the lower periphery 48, and the other portion 49*c* having a fixed depth. The skin-mounting part 46 has a triangular projection 47 projecting downward from a lower surface thereof, and has second recessed parts 50 (reduced cross-sectional area portions) formed in respective left and right half portions of the lower surface of the triangular projection 47 with a transversely central portion of the same left unrecessed. Further, the lower surface of the shank roller-pushing part 42 is formed with a groove 52 in which one end of a repetition spring 6 (see FIG. 2) is engaged.

On the other hand, the lever button-mounting part 43 has approximately the same width as that of the rear end of the shank roller-pushing part 42 and approximately the same height as that of the wippen-mounting part 41. Further, the lever button-mounting part 43 has a lower surface whose rear end part is formed as a sloping surface sloping upward as it extends rearward, and a screw hole 51 for mounting a lever button 28 (see FIG. 2) is formed in a manner obliquely extending through the lever button-mounting part 43 between the sloping surface and the upper surface. The lever button-mounting part 43 have third recessed parts 54 (only one of which is shown) formed in respective left and right side surfaces thereof to form a reduced cross-sectional area portion, with peripheries 53 thereof left unrecessed. Each of the third recessed parts 54 has a predetermined fixed depth except a shallowly recessed portion around the screw hole 51.

Figure 2:
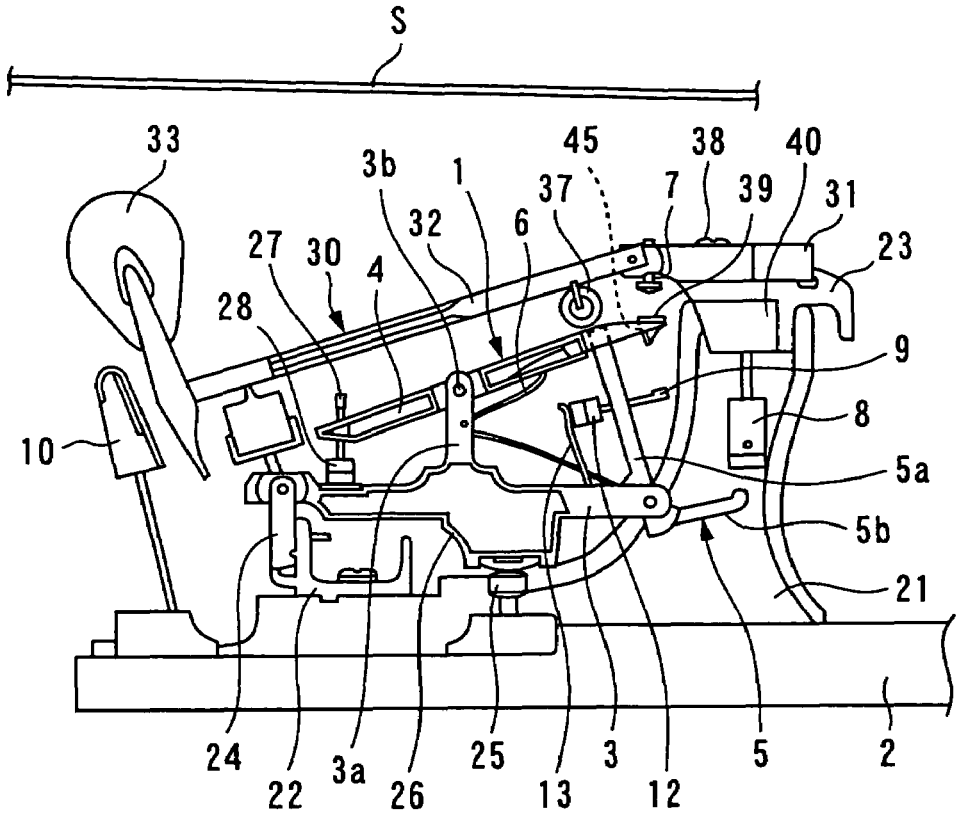

Next, the arrangement of the action 1 including the repetition lever 4 constructed as above will be described with reference to FIG. 2. The action 1 is provided for each of the large number of keys 2 (only one of which is shown). As shown in FIG. 2, the action 1 is comprised of the wippen 3 which is pivotally movable and extends in the front-rear direction, and the repetition lever 4 and the jack 5 which are pivotally mounted to the wippen 3. The action 1 is mounted between left and right brackets 21 and 21 (only one of which is shown). The left and right brackets 21 and 21 are rigidly secured to the respective left and right end parts of a keyframe (not shown) on which the associated keys 2 are placed, and a wippen rail 22 is disposed between the brackets 21 and 21. The rear end of the wippen 3 is pivotally mounted to wippen flanges 24 screwed to the wippen rail 22. Each of the wippens 3 is disposed on a capstan button 25 provided on the rear part of the upper surface of the associated key 2, via a wippen heel 26.

A hammer shank rail 23 extends between the left and right brackets 21 and 21. A large number of shank flanges 31 (only one of which is shown) are rigidly secured to the hammer shank rail 23 by respective screws 38, and each hammer 30 is pivotally supported by a corresponding one of the shank flanges 31. The hammer 30 is comprised of a hammer shank 32 having a front end part thereof pivotally mounted to the corresponding shank flange 31, and a hammer head 33 mounted to a rear end of the hammer shank 32. A cylindrical shank roller 37 is attached to the lower surface of the hammer shank 32 at a predetermined location close to the front end of the same. Further, a back check 10 is erected on the rear end part of the key 2 in a manner opposed to the hammer 30 from the rear side.

The wippen 3 has a bifurcated lever-mounting part 3*a* extending upward, and a piece of bushing cloth (not shown) is bonded to each of holes (not shown) formed in the respective bifurcated portions of the lever-mounting part 3*a*. Between the two pieces of bushing cloth, there is horizontally mounted a pin 3*b*. The repetition lever 4 is pivotally mounted to the wippen 3 via the pin 3*b* inserted through the mounting hole 44, such that the wippen-mounting part 41 is engaged with the lever-mounting part 3*a*. A lever screw 27 is vertically screwed through the screw hole 51 formed in the rear end part of the repetition lever 4, such that the lever screw 27 can be screwed in and out, and the lever button 28 is formed integrally with the lower end of the lever screw 27. The repetition lever 4 is urged in a returning direction (counterclockwise direction as viewed in FIG. 2) by the repetition spring 6 mounted to the wippen 3 and engaged in the groove 52. With this arrangement, when the key 2 is in a released state, the repetition lever 4 is held in a state pivotally moved to a return side by the resilient force of the repetition spring 6, and the lever button 28 is held in contact with the upper surface of the wippen 3. The angle of the repetition lever 4 in the key-released state can be adjusted by turning the lever screw 27.

Figure 5:
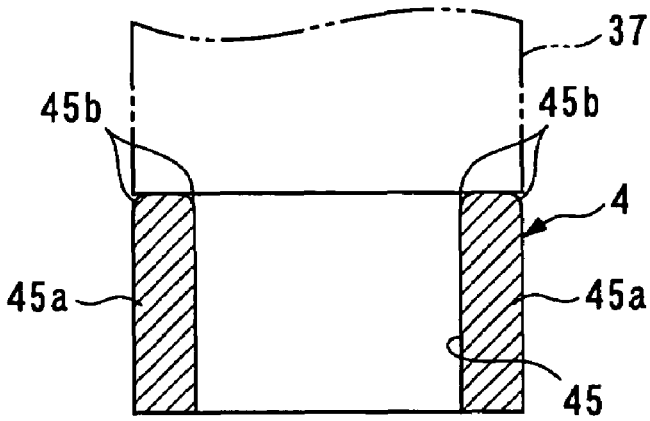

In the vicinity of the jack guide hole 45 of the repetition lever 4, the hammer 30 is disposed on the upper surface of the repetition lever 4 via the shank roller 37. As shown in FIG. 5, the shank roller 37 is formed to have a width approximately equal to the distance between the outer ends of the respective wall parts 45*a* and 45*a* defining the jack guide hole 45, so that the shank roller 37 can be placed on the wall parts 45*a* and 45*a* in a manner extending over the entire width of the jack guide hole 45. To the upper surface of the skin-mounting part 46 is affixed the lever skin 39 in a manner opposed to a drop screw 7 screwed into the shank flange 31 from below such that it can be screwed in and out. With this arrangement, it is possible to turn the drop screw 7 for adjustment of the amount of downward projection thereof, to thereby adjust timing in which the repetition lever 4 comes into abutment with the drop screw 7 via the lever skin 39.

The jack 5 is formed into an L-shape by a hammer push-up part 5*a* vertically extending and having a rectangular shape in cross section, and a regulating button abutment part 5*b* extending rearward from a lower end of the hammer push-up part 5*a* substantially at right angles thereto. The jack 5 has its corner pivotally attached to the front end of the wippen 3. An upper end of the hammer push-up part 5*a* is engaged in the jack guide hole 45 of the repetition lever 4 such that the upper end of the hammer push-up part 5*a* can move in the front-rear direction. In the key-released state, the upper end of the hammer push-up part 5*a* is opposed to the shank roller 37 with a slight space therebetween. Further, the jack 5 is urged in a returning direction (counterclockwise direction as viewed in FIG. 2) by the repetition spring 6 urging the repetition lever 4.

A jack button screw 9 for adjusting an angular position of the jack 5 is screwed through an intermediate portion of the hammer push-up part 5*a* of the jack 5 in the front-rear direction such that it can be screwed in and out. A jack button 12 is formed integrally with an end of the jack button screw 9. In the key-released state, the jack button 12 is in abutment with a spoon 13 erected on the wippen 3. Therefore, by turning the jack button screw 9, it is possible to adjust the angular position of the jack 5 in the key-released state.

This angle adjustment by the jack 5 is performed with reference to the marking lines 57*a* or the lower stepped parts 56 formed in the repetition lever 4 as shown in FIG. 4. More specifically, in the case where the marking lines 57*a* are used as the reference, the point of intersection between the rear-side marking line 57*a* and the upper surface of the repetition lever 4 is set to a reference point B, and the jack button screw 9 is turned so as to align a rear surface 5*c* of the jack 5 with the reference point B, whereby the jack 5 is adjusted to a predetermined angular position. In this state, the rear surface 5*c* of the jack 5 is aligned with the front surface of the lower stepped part 56 based on the angular relationship between the marking line 57*a* and the front surface of the lower stepped part 56. Therefore, by using the lower stepped parts 56 as the reference and aligning the rear surface 5*c* of the jack 5 with the front surface of the lower stepped parts 56, it is also possible to adjust the jack 5 to a predetermined angular position. As described above, the angular position of the jack 5 can be adjusted using either of the marking lines 57*a* and the lower stepped parts 56.

On the other hand, a regulating rail 40 is screwed onto the lower surface of the hammer shank rail 23. A regulating button 8 for restricting upward pivotal motion of the jack 5 is screwed into the lower surface of the regulating rail 40 such that it can be screwed in and out, and is opposed to the leading end of the regulating button abutment part 5*b* of the jack 5, with a predetermined space therebetween.

The operation of the action 1 configured as above is basically the same as that of the conventional action described hereinbefore. More specifically, as the key 2 is depressed in the key-released state illustrated in FIG. 2, the wippen 3 is pushed up via the capstan button 25 to pivotally move upward, and the repetition lever 4 and jack 5 mounted to the wippen 3 also pivotally move upward along with the wippen 3. Along with this pivotal motion, the repetition lever 4 comes into abutment with the drop screw 7 via the lever skin 39, and at the same time the jack 5 pushes up the hammer 30 via the shank roller 37 to pivotally move the hammer 30 upward. Thereafter, when the hammer 30 pivotally moves immediately close to a position for striking a string S stretched above, the jack 5 comes into engagement with the regulating button 8 whereby the jack 5 is released from the shank roller 37. This disconnects the hammer 30 from the action 1 and the key 2 to strike the string S in a free rotation state.

After having struck the string S, the hammer 30 pivotally returns in the opposite direction to be stopped by the back check 10. Then, when the key 2 is released, the hammer 30 is released from the back check 10 at which it is stopped, and in timing in which the key 2 is returned to a predetermined height, the repetition lever 4 moves away from the drop screw 7 and is pivotally moved about the wippen 3 by the resilient force of the repetition spring 6 to return in the counterclockwise direction, to thereby push up the hammer 30 via the shank roller 37. Thus, the jack 5 is pivotally returned by the resilient force of the repetition spring 6 to be positioned under the shank roller 37, whereby a following string-striking operation can be reliably performed even when the key 2 is not completely returned, thereby ensuring the capability of repeated key striking.

As described above, according to the present embodiment, since the repetition lever 4 is formed by an ABS resin molded article which is molded by a long fiber process, and contains relatively long carbon fibers having a length of 0.5 to 2 mm as reinforcing long fibers, it is possible to obtain a very high rigidity, i.e. a rigidity not lower than that of a wooden repetition lever. As a result, deflection of the repetition lever 4 occurring in pushing up the hammer 30 after having struck the string can be suppressed, which enables the repetition lever 4 to perform the operation of pushing up the hammer 30 in predetermined timing. Further, since the ABS resin molded article molded by the long fiber process is as excellent in shape retainability and dimensional stability as a molded article of a single synthetic resin, it is possible to reduce deformation, such as warpage and torsion, of the repetition lever 4, and expansion and contraction of the same due to dryness and wetness, to much smaller amounts than in the case where the repetition lever 4 is made of wood. Thus, the stable operation of the repetition lever 4 can be ensured, and the capability of repeated key striking can be enhanced.

Further, in the present embodiment, since carbon fibers are used as the reinforcing long fibers contained in the repetition lever 4, it is possible to increase the electric conductivity of the repetition lever 4 to thereby reliably release static electricity generated by friction between the repetition lever 4 and other component parts including the hammer 30, to thereby prevent the repetition lever 4 from being electrostatically charged. This makes it possible to suppress attachment of dust to the repetition lever 4 and its neighborhood, thereby maintaining excellent operation and appearance of the repetition lever 4.

Further, in the present embodiment, since the ABS resin having a relatively high adhesiveness is used as the thermoplastic resin for forming the repetition lever 4, the lever skin 39, the pieces of bushing cloth, and other component parts can be easily mounted to the repetition lever 4 by bonding, which increases the ease of assembly of the repetition lever 4.

Figure 3:
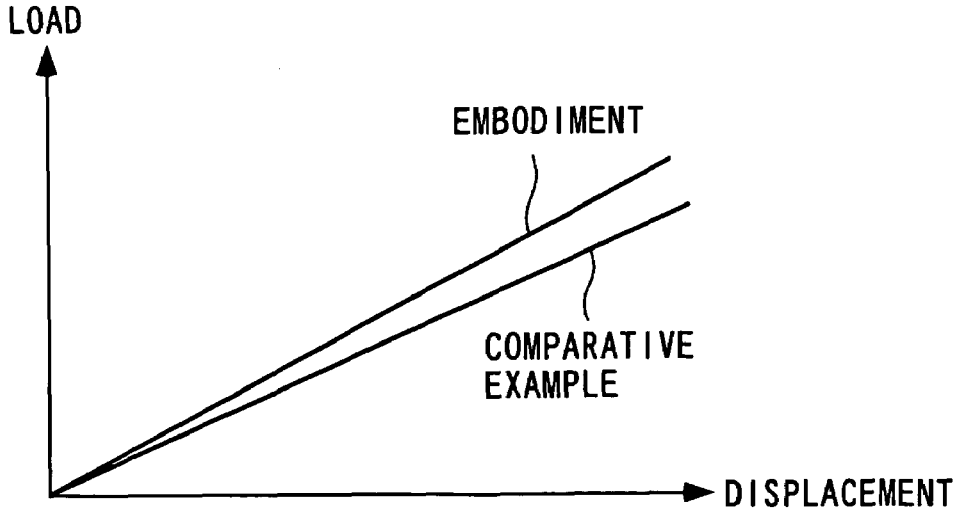

FIG. 3 shows results of a test carried out so as to confirm effects of reinforcement of rigidity of the repetition lever according to the present embodiment, together with those of a test on Comparative Example. The repetition lever of Comparative Example is made of wood (hornbeam), and the present embodiment and Comparative Example are identical in size and shape. In the test, in a state where the opposite ends of each repetition lever are held, displacement of the repetition lever was measured while applying load from above to a central portion thereof, and rigidity of the repetition lever was calculated based on the relationship between the load and the displacement measured at the time. Further, the same number of samples of each of the embodiment and Comparative Example were prepared. FIG. 3 shows the relationships between the respective average loads and average displacements of the embodiment and Comparative Example.

As shown in FIG. 3, according to the test result, it was confirmed that the rigidity of the repetition lever according to the present embodiment was increased by approximately 13% in comparison with that of Comparative Example, and the repetition lever of the present embodiment has a considerably larger rigidity than the wooden repetition lever. Further, although not shown, it was also confirmed that variation in rigidity among the samples is smaller in the present embodiment. As described above, insofar as the repetition levers have the same size and shape, it is possible to obtain a considerably larger rigidity when the material of the present embodiment is used than when the repetition lever is made of wood. Therefore, by forming the aforementioned first to third recessed parts 49, 50, and 54 (reduced cross-sectional area portions) in the repetition lever 4, it is possible to reduce the weight of the repetition lever 4 as much as possible while maintaining the same rigidity as that of the conventional wooden repetition lever having no such reduced cross-sectional area portions, thereby enhancing the capability of repeated key striking.

Further, since the wall parts 45*a* of the jack guide hole 45 of the repetition lever 4 are chamfered, and the shank roller 37 of the hammer 30 is disposed on the wall parts 45*a*, the contact area between the repetition lever 4 and the shank roller 37 is reduced, which makes it possible to reduce frictional resistance to thereby reduce the static load on the key. Although not shown, it was confirmed from a test therefore that the static load on the key is reduced by 1 to 3 g.

It should be noted that the present invention is by no means limited to the embodiment described above, but it can be practiced in various forms. For example, although in the embodiment, the ABS resin is used as a thermoplastic resin, and the carbon fibers are used as reinforcing long fibers, it is possible to use other appropriate materials. For example, glass fibers may be employed for the latter. Further, although in the embodiment, the first to third recessed parts 49, 50, and 54 are formed as reduced cross-sectional area portions for reducing the weight of the repetition lever, if priority is given to rigidity, such reduced cross-sectional area portions may be dispensed with. Furthermore, although in the embodiment, the present invention is applied to the repetition lever for an acoustic grand piano, it may be applied to a repetition lever for a grand-type electronic piano and one for an automatic playing piano. It is to be further understood that various changes and modifications may be made without departing from the spirit and scope thereof.

INDUSTRIAL APPLICABILITY

As described above, the present invention enables a repetition lever for providing the capability of repeated key striking of a grand piano to stably perform required operations, and hence it is useful in improving the capability of repeated key striking.

The invention claimed is:

1. A repetition lever for a grand piano, which performs the operation of pushing up a hammer after the hammer has struck a string, wherein the repetition lever is formed by a molded article of a thermoplastic resin containing long fibers for reinforcement, the molded article being molded by a long fiber process, wherein the repetition lever has a shank roller-pushing part having left and right wall parts which define a jack guide hole for guiding a jack and on which a shank roller of the hammer rides, and wherein each of the left and right wall parts has left and right upper edges chamfered.

2. A repetition lever as claimed in claim 1, wherein the long fibers have a length not shorter than 0.5 mm.

3. A repetition lever as claimed in claim 1, wherein the long fibers are carbon fibers.

4. A repetition lever as claimed in claim 1, wherein the thermoplastic resin is an ABS resin.

5. A repetition lever as claimed in claim 1, wherein the repetition lever has a reduced cross-sectional area portion for reducing weight thereof.

6. A repetition lever as claimed in claim 1, wherein the shank roller-pushing part has at an outer side surface thereof a marking line as a reference in adjusting an angular position of the jack.

7. A repetition lever for a grand piano, which performs the operation of pushing up a hammer after the hammer has struck a string, wherein the repetition lever is formed by a molded article of a thermoplastic resin containing long fibers for reinforcement, the molded article being molded by a long fiber process, wherein the repetition lever has a shank roller-pushing part having left and right wall parts which define a jack guide hole for guiding a jack and on which a shank roller of the hammer rides, and wherein the shank roller-pushing part has at a left and/or a right outer side surface thereof a marking line as a reference in adjusting an angular position of the jack.

8. A repetition lever as claimed in claim 7, wherein the long fibers have a length not shorter than 0.5 mm.

9. A repetition lever as claimed in claim 7, wherein the long fibers are carbon fibers.

10. A repetition lever as claimed in claim 7, wherein the thermoplastic resin is an ABS resin.

11. A repetition lever as claimed in claim 7, wherein the repetition lever has a reduced cross-sectional area portion for reducing weight thereof.

* * * * *